United States Patent [19]

Jorwa

[11] 4,050,790

[45] Sept. 27, 1977

[54] SELF-STYLING AND UTILITY MIRROR WITH FOUR SURFACES

[76] Inventor: Mildred M. Jorwa, 71 Lincoln Ave., Fair Lawn, N.J. 07410

[21] Appl. No.: 631,898

[22] Filed: Nov. 14, 1975

[51] Int. Cl.[2] ..... G02B 5/08

[52] U.S. Cl. ..... 350/305; 362/346; 350/299

[58] Field of Search ..... 240/4.1, 4.2; 354/220; 350/305, 306, 288, 299

[56] References Cited

U.S. PATENT DOCUMENTS

| | | | |
|---|---|---|---|
| 226,362 | 4/1880 | Short | 350/305 |
| 1,451,236 | 4/1923 | Stanfield | 350/305 |
| 2,175,105 | 10/1939 | Bryn | 350/305 |

*Primary Examiner*—F. L. Evans

*Attorney, Agent, or Firm*—Mel K. Silverman; David A. Jackson

[57] ABSTRACT

The present invention constitutes a self-styling mirror including four planer surfaces connected along adjacent edges thereof. The two outer surfaces are angularly moveable with respect to the two inner surfaces. The self-styling mirror is secured upon a vertical pole and is vertically moveable up and down the pole. Further, the entire four-mirror system is universally moveable about a universal joint which depends transversely from said vertical member.

3 Claims, 7 Drawing Figures

SELF-STYLING AND UTILITY MIRROR WITH FOUR SURFACES

BACKGROUND OF THE INVENTION

The present invention relates to mirrors utilized in the cosmetic field and, more particularly, relates to a so-called self-styling mirror which can be utilized by the individual upon whom the cosmetic or hair-styling procedure is to be performed.

The prior art in this field is comprised primarily of mirrors having three surfaces and, for example, includes such patents as U.S. Pat. No. 1,680,076 (1928) to Wiederhold; U.S. Pat. No. 2,201,251 (1940) to Van Patten; U.S. Pat. No. 3,620,605 (1971) to Clark, and U.S. Pat. No. 3,794,828 (1974) to Arpino.

None of the above prior art enables the user of the cosmetic mirror to see every point of his or her head and neck. Accordingly, the present invention represents an attempt to fill this, and other, shortcomings in the prior art.

SUMMARY OF THE INVENTION

The present invention constitutes a self-styling mirror, including four planer surfaces, connected along contiguous edges thereof. Each outer surface is angularly moveable with respect to each inner surface. The self-styling mirror is mounted upon a vertical pole and may be selectively moved up and down said pole. Further, the entire four-mirror system is universally moveable about a universal joint which depends from said vertical member.

It is an object of the present invention to produce a multi-purpose self-styling cosmetic mirror.

It is a further object to attain a multi-purpose cosmetic mirror capable of movement in three planes and, further, capable of relative movement between each of the constituent planes of said mirror.

DETAILED DESCRIPTION OF THE INVENTION

Figure 1:
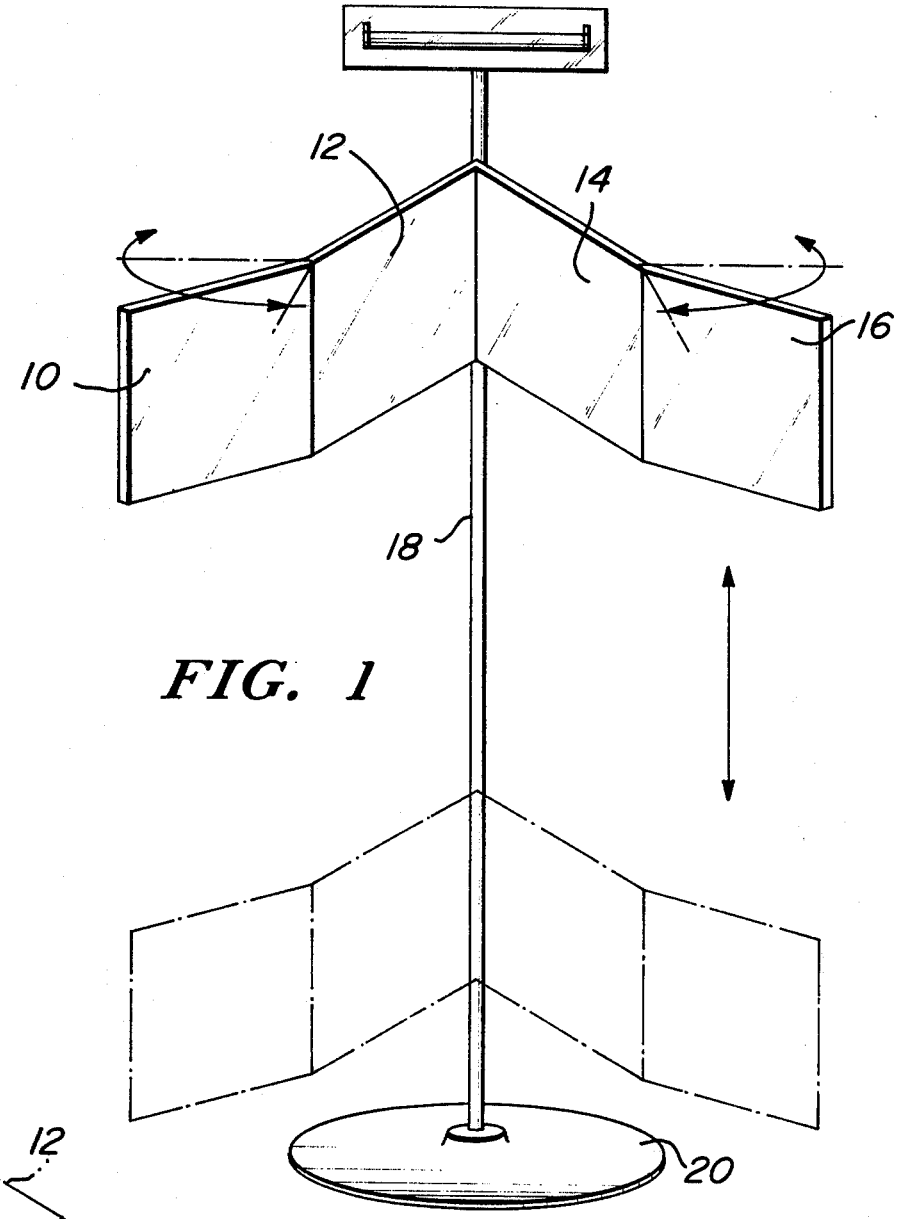
FIG. 1 is a schematic view of the present invention, particularly illustrating the relative angular movement of the planes of said mirror system as well as the vertical moveability of the system upon the vertical member of the system.

Shown in FIG. 1 is the basic four-sided mirror system of the present invention. Said invention includes a first surface 10 connected by a longitudinal attachment means, such as a piano hinge, to a second mirror 12 which is connected in a fixed relationship to a third mirror 14 which in turn is angularly moveably connected to a fourth mirror 16, utilizing a connection similar to the piano hinge connection between surfaces 10 and 12. Accordingly, it may be appreciated that the basic reflecting structure of the present invention consists of a central wedge-shaped area comprising two mirrored surfaces disposed at a fixed mutual angle of between 80° and 130°. Angularly connected at the outer edges of the inner area are two additional mirrors, of similar dimension to each inner mirror, however, having an angular moveability with relationship to the two inner mirrors.

With a further reference to FIG. 1, it is noted that the entire mirror structure is vertically moveable upon a vertical member 18 which in turn is supported by a base 20, having sufficient weight so as to support the structure of the mirror system. As an optional addition to said base, castors may be provided in order to afford a ready mobility of the system.

Figure 2:
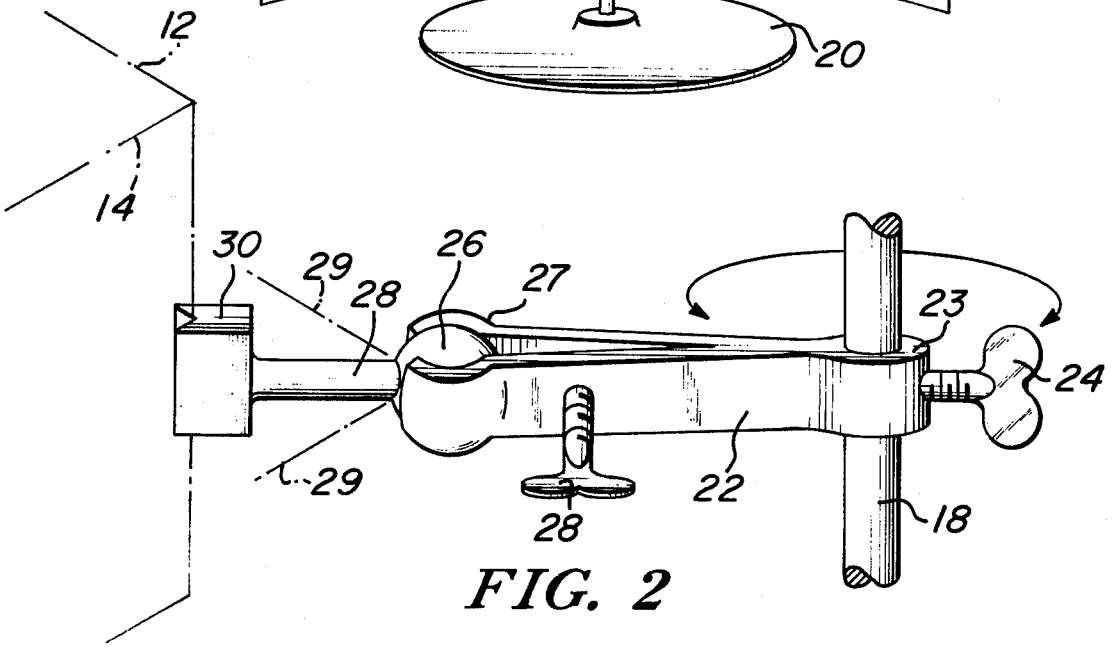
FIG. 2 is a detailed view of the three-dimensional selective movement assembly of the present invention.

Shown in FIG. 2 are a plurality of positioning means which serve to turn and to rotate the mirror system to any desired attitude. More particularly, it is noted that the combination of a collar 23 and a wing nut 24, about the vertical member 18 permits, an angular rotation of the entire system about said member.

Further, it is noted that a combination of a universal joint 26, its enclosure 27, and a wing nut 28 serve to provide the present mirror system with a broad range of rotation within the spherical segment indicated by lines 29. Further, it is noted that member 28 and element 30 serve to connect the wedge-shaped combination of elements 12 and 14 to the universal joint 26 and, further, that element 30 serves to maintain elements 12 and 14 in their desired fixed angle of disposition to each other.

It is to be noted that, as shown in FIG. 1, the present system may be provided with a fluorescent lamp, or other lighting means, in order to provide required illumination for the user.

Figure 3:
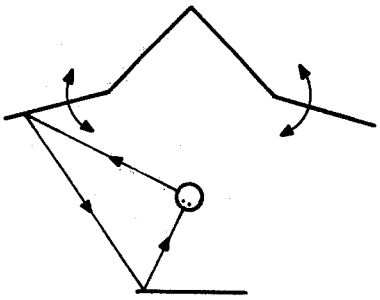
FIG. 3 is a diagrammatic view of the optics of the present invention as utilized in combination with a plane frontal mirror.

FIG. 3 is an example of a usage of the present mirror system in conjunction with a frontally disposed uniplaner mirror. It is to be noted that in the arrangement of FIG. 3, the user is able to see the side of her head.

Figure 4:
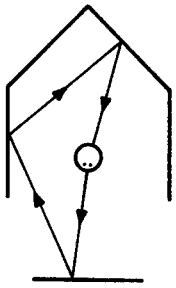
FIG. 4 is a second diagramatic view of the optics of the present invention utilized in association with a front plane mirror, however showing a different arrangement of the mirror system.

FIG. 4 is another arrangement of the present mirror system, utilized in conjunction with a frontally disposed uniplaner mirror. In this arrangement, the user is able to see the back of her head.

Figure 5:
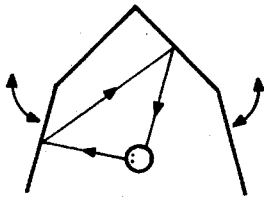
FIG. 5 is a diagramatic view of the optics of the present invention utilized without any supplemental mirror.

FIG. 5 is an example of the present mirror system used without any other mirror in which the user is able to observe the side and back of her head.

Figure 6:
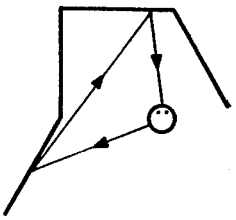
FIG. 6 is a second view of the present system utilized without a supplemental mirror.

FIG. 6 represents another example of the manner in which the present mirror system may be used in order to observe the sides of one's head.

Figure 7:
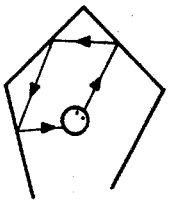
FIG. 7 is a third view of the present system utilized without the supplemental mirror.

FIG. 7 represents a yet further example of the manner in which the present system may be utilized.

Accordingly, it is seen that the above object of attaining a multi-purpose self-styling cosmetic mirror has been attained by the above detailed description of the invention.

Further, it is to be appreciated that the present mirror system may be utilized in a variety of domestic applications such as the hemming of dresses, slacks and coats.

While there have been herein shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea of principles of this invention within the scope of the appended claims.

Having thus described my invention what I claim as new, useful and non-obvious and accordingly secure by Letters Patent of the United States is:

1. A self-styling utility mirror comprising:

four planar mirrored surfaces contiguous at the vertical edges thereof, said surfaces comprising two inner surfaces fixedly attached to each other at said vertical edges, said inner surfaces lying in vertical planes disposed at an angle ranging from 80 - 130° with respect to each other, and two outer surfaces located in rotatable hinged attachment to respective inner surfaces and adapted for horizontal rotation about the vertical axis defined by said hinged attachment;

a vertical support structure having a weighted base; and means for attachment of said mirror to said vertical support to enable the omni-directional movement of said mirror with respect to said support.

2. The mirror as recited in claim 1 in which said attachment means includes a universal joint.

3. The mirror as recited in claim 2 in which said attachment means further includes a circular collar arrangement about said vertical member by which angular rotation about said vertical member is obtained.

* * * * *